US010633865B1

(12) United States Patent
Czaplicki et al.

(10) Patent No.: US 10,633,865 B1
(45) Date of Patent: Apr. 28, 2020

(54) RODENT AND INSECT PROOF SOFFIT VENT

(71) Applicants: Robert Czaplicki, Tequesta, FL (US); Susan Czaplicki, Tequesta, FL (US)

(72) Inventors: Robert Czaplicki, Tequesta, FL (US); Susan Czaplicki, Tequesta, FL (US)

( * ) Notice: Subject to any disclaimer, the term of this patent is extended or adjusted under 35 U.S.C. 154(b) by 0 days.

(21) Appl. No.: 16/165,466

(22) Filed: Oct. 19, 2018

(51) Int. Cl.
*E04D 13/00* (2006.01)
*E04D 13/17* (2006.01)
*E04D 13/152* (2006.01)

(52) U.S. Cl.
CPC ..... *E04D 13/004* (2013.01); *E04D 13/152* (2013.01); *E04D 13/178* (2013.01)

(58) Field of Classification Search
CPC .... E04D 13/004; E04D 13/178; E04D 13/152
See application file for complete search history.

(56) References Cited

U.S. PATENT DOCUMENTS 1,640,588 A * 8/1927 Yager ..... F24F 13/08 454/280
1,651,071 A * 11/1927 Scheppers ..... E04D 13/178 160/327
2,718,187 A * 9/1955 Frisby ..... E04D 13/152 454/260
3,018,713 A * 1/1962 Anderson ..... E04D 13/152 454/260
3,051,071 A * 8/1962 Leigh ..... E04D 13/152 454/260
3,125,942 A * 3/1964 Smith ..... E04D 13/152 454/260
3,181,275 A * 5/1965 Wood ..... E04D 13/158 52/478
3,232,205 A * 2/1966 Bumstead ..... E04D 13/152 160/104
4,407,187 A * 10/1983 Horney ..... F24F 13/12 454/324
5,718,086 A * 2/1998 Dunn ..... E04D 13/152 454/260
5,799,446 A * 9/1998 Tamlyn ..... E04D 13/158 52/302.1
5,881,502 A * 3/1999 Tamlyn ..... E04D 13/152 52/94

(Continued)

FOREIGN PATENT DOCUMENTS

CA 2269414 A1 * 10/1999 ..... E04D 13/152
WO WO-03001006 A1 * 1/2003 ..... E04D 13/152

OTHER PUBLICATIONS

Anonymous, "Soffitt vents archive", Retrieved from the Internet Jan. 14, 2019, http: rutlandguttersupply.com/product-category/vents/soffitt-vents/, (2019).

*Primary Examiner* — Jessie T Fonseca
(74) *Attorney, Agent, or Firm* — McHale & Slavin, P.A.

(57) ABSTRACT

A soffit vent for allowing passage of air into an interior area of a structure having the soffit. The soffit vent is configured to prevent or minimize animals from entering into the interior area through the soffit vent. The soffit vent may comprise an outer frame having a space or gap, an inner frame having a space or gap; and a soffit vent grill; the soffit vent grill positioned or secured in between the outer frame and the inner frame in a manner which prevents vertical, horizontal, and inward movement.

16 Claims, 16 Drawing Sheets

(56) References Cited

U.S. PATENT DOCUMENTS

| | | | | |
|---|---|---|---|---|
| 6,718,699 | B1 * | 4/2004 | Larson | E04D 13/178<br>52/371 |
| 7,195,556 | B1 * | 3/2007 | Fichtelman | E04D 13/152<br>454/260 |
| 7,484,335 | B1 * | 2/2009 | Dunlap | E04D 13/152<br>52/302.3 |
| 7,909,686 | B2 * | 3/2011 | Achen | F24F 13/082<br>454/277 |
| 7,987,649 | B1 * | 8/2011 | Polston | E04D 13/152<br>454/260 |
| 2002/0124484 | A1 * | 9/2002 | Martin | E04D 13/152<br>52/94 |
| 2003/0186604 | A1 * | 10/2003 | Nourigat | A01M 1/04<br>442/123 |
| 2004/0216397 | A1 * | 11/2004 | Sigmund | E04D 13/152<br>52/95 |
| 2005/0178076 | A1 * | 8/2005 | Rasmussen | E04D 13/152<br>52/96 |
| 2006/0240762 | A1 * | 10/2006 | Railkar | E04D 13/152<br>454/260 |
| 2007/0234650 | A1 * | 10/2007 | Coulton | E04D 13/152<br>52/95 |
| 2008/0072503 | A1 * | 3/2008 | Brochu | E04D 13/152<br>52/94 |
| 2009/0084067 | A1 * | 4/2009 | Platts | E04D 13/152<br>52/745.21 |
| 2009/0311958 | A1 * | 12/2009 | Grubka | F24F 7/02<br>454/366 |
| 2013/0227900 | A1 * | 9/2013 | Peterson | E04D 13/172<br>52/302.1 |
| 2013/0247480 | A1 * | 9/2013 | Ridgway | E04D 13/178<br>52/95 |

* cited by examiner

RODENT AND INSECT PROOF SOFFIT VENT

FIELD OF THE INVENTION

The present invention relates to venting systems; to soffit vents; and more particularly, to soffit vents designed to prevent or minimize damage thereto by rodents or insects.

BACKGROUND OF THE INVENTION

Many commercial or residential structures utilize vents to allow ventilation of attics and other interior areas to allow cool air from outside the structure to be inducted into the attic. As the air enters the attic through the soffit vent, it starts to warm with the heating of the sun. The warm air gradually rises and is forced out of the attic at the ridge vent or gable vent at the top of the roof line. As the warm air is forced out of the ridge vent, a vacuum is created in the attic, forcing more cool air to be sucked into the soffit vents, creating a continuous ventilation system. Soffit vents also serve a very important function in controlling moisture buildup, which could lead to mold problems with air circulation. In cold weather areas, soffit vents have an important function in allowing cool air into the attic to stop snow melt on the roof, whereas icing or damming can cause ice to back up under shingles and cause leaks.

Soffit or eave vents may simply include a grill secured to a portion of the soffit or eave. Alternatively, soffit or eave vents may include an outer frame that includes a grill secured thereto. These types of vents are then secured to the soffit or eave openings. One of the problems associated with current soffit or eave vents relates to keeping animals, such as rodents, from getting into the interior portion of the building through the soffit or eave vents. The problem arises as the typical soffit or eave vent is very susceptible to destruction by rodent biting or forces exerted by the rodents "pushing" the grill inward in an attempt to get inside the building. Such forces often cause the outer frame to bow, break, or result in at least a portion of the grill separating from the frame, thus providing a mechanism for entry. Once rodents creates even a small opening or tear within the vent, access into the interior portion is accomplished.

Accordingly, an insect or rodent proof soffit or eave vent is needed in the art.

SUMMARY OF THE INVENTION

The present invention is directed towards a soffit vent for allowing passage of air into an interior area of a structure having the soffit. The soffit vent is configured to prevent or minimize animals from entering into the interior area through the soffit vent. The soffit vent may comprise an outer frame having a space or gap, an inner frame having a space or gap, and a soffit vent grill; the soffit vent grill positioned or secured in between the outer frame and the inner frame in a manner which prevents vertical, horizontal, and inward movement. Alternatively, the soffit vent may comprise an outer frame having a space or gap, and a soffit grill, the soffit vent grill positioned or secured within the outer frame in a manner which prevents vertical, horizontal, and inward movement.

Accordingly, it is an objective of the invention to provide a soffit or eave vent that prevents or minimizes rodents or other animals from accessing an interior of a building.

It is a further objective of the invention to provide an appealing soffit or eave vent that is also configured to prevent or minimize rodents or other animals from accessing the interior of a building through the vent.

It is yet another objective of the invention to provide a soffit or eave vent that prevents or minimizes rodents or other animals from accessing an interior of a building that can be attached or secured to a preexisting soffit or eave opening.

It is a still further objective of the invention to provide a soffit or eave vent that prevents or minimizes rodents or other animals from accessing an interior of a building that is easily secured to a soffit or eave opening.

It is a further objective of the invention to provide a soffit or eave vent that prevents or minimizes rodents or other animals from accessing an interior of a building that is easily removed or replaced from a soffit or eave opening.

It is yet another objective of the invention to provide a soffit or eave vent in which a soffit grill is secured or positioned in place that prevents the grill from vertical movement.

It is a still further objective of the invention to provide a soffit or eave vent in which a soffit grill is secured or positioned in place that prevents the grill from horizontal movement.

It is a further objective of the invention to provide a soffit or eave vent in which a soffit grill is secured or positioned in place that prevents the grill from inward movement.

It is yet another objective of the invention to provide a soffit or eave vent in which a soffit grill is secured or positioned in place that prevents the grill from vertical movement, horizontal movement, and inward movement.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
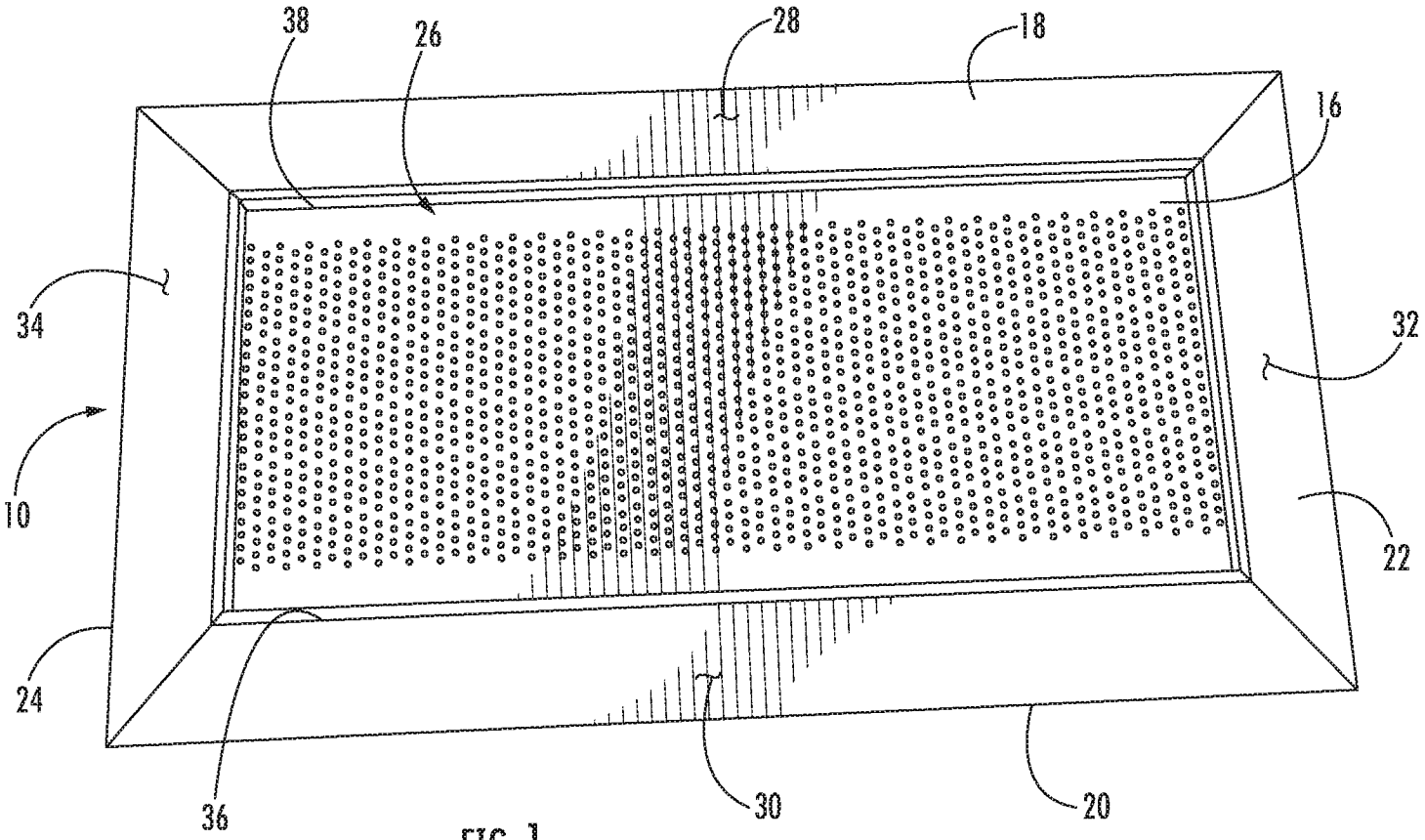
FIG. 1 is a perspective view of an illustrative example of an insect and rodent proof soffit vent.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated. In addition, while each figure may show embodiments having one or more components or elements that define the invention, it is understood that the figures are illustrative only and the invention may be defined or claimed by one, some, all, or any combination of the individual components or elements shown in the figures or described in other figures or parts of the description herein.

Figure 2:
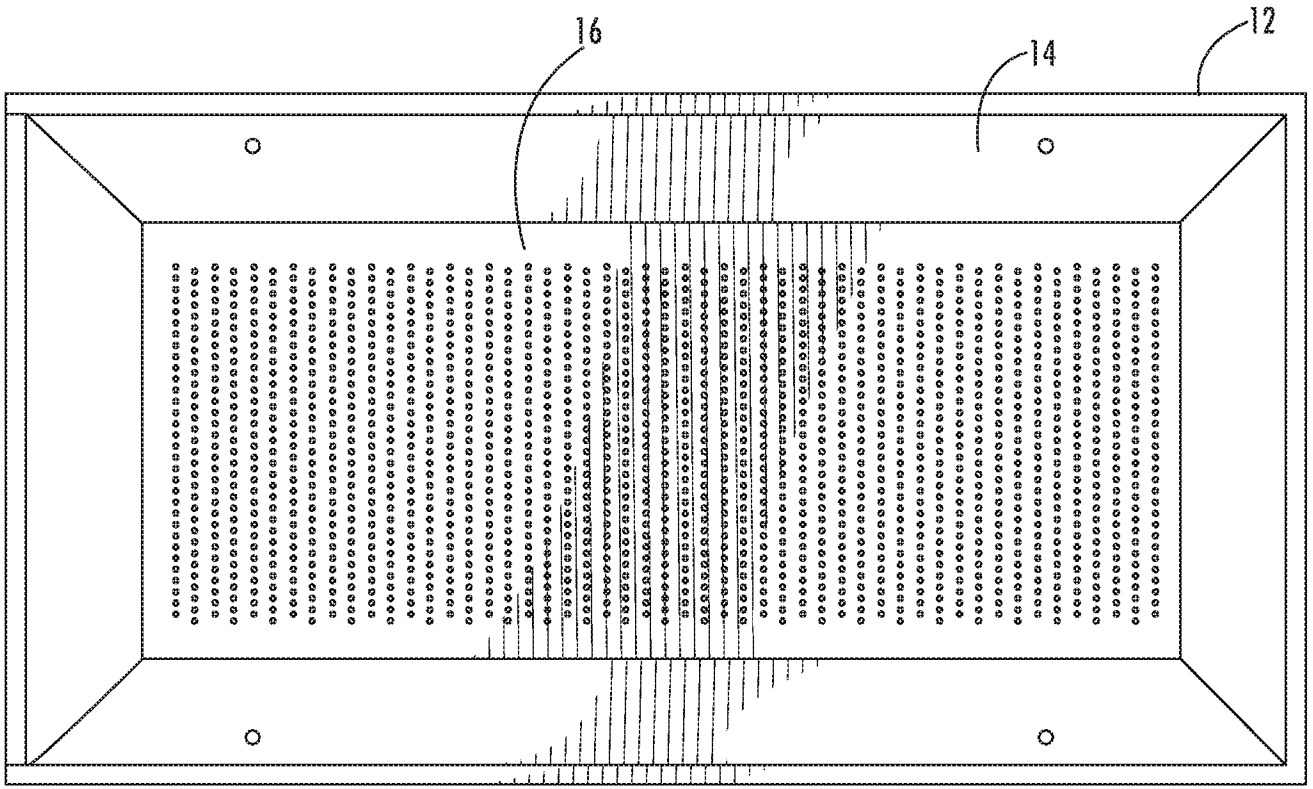
FIG. 2 illustrates a bottom perspective view of the insect and rodent proof soffit vent.
Figure 3:
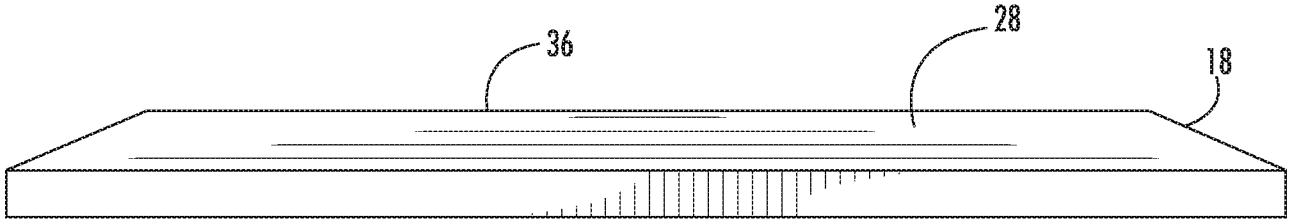
FIG. 3 is a left-side view of the insect and rodent proof soffit vent.
Figure 4:
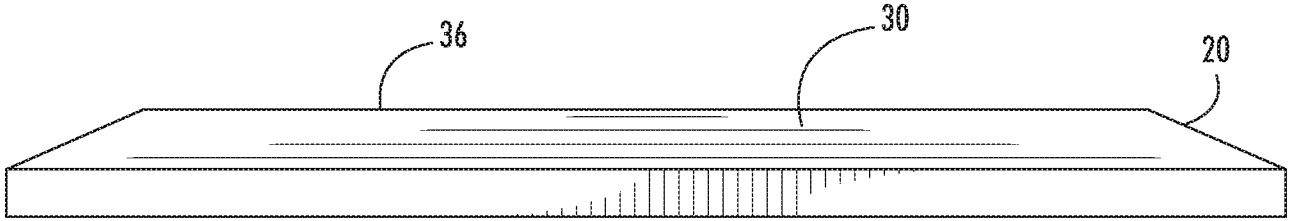
FIG. 4 is a right-side view of the insect and rodent proof soffit vent.
Figure 5:
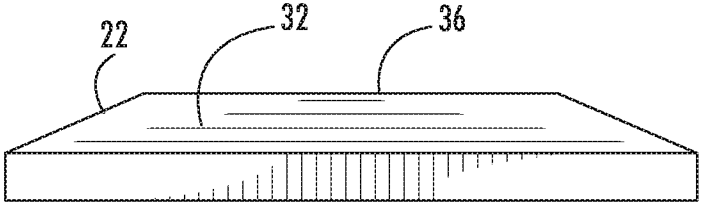
FIG. 5 is a front view of the insect and rodent proof soffit vent.
Figure 6:
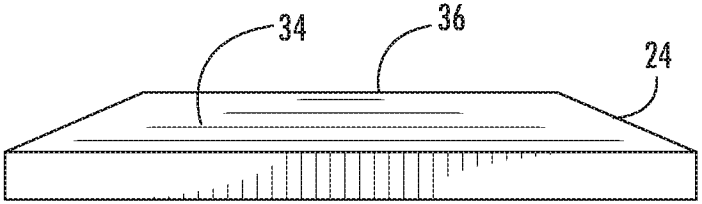
FIG. 6 is a back view of the insect and rodent proof soffit vent.

Referring to FIGS. 1 and 2, an insect and rodent proof soffit vent, referred to generally as a soffit vent 10, is illustrated. The soffit vent 10 may be installed into a building's soffit or eave areas, particularly an opening on the bottom of the soffit or eaves. The soffit vent 10 is configured to allow passage of air into/from the soffit or eave while preventing or minimizing animals, such as rodents, from entering into the building through the opening. The soffit vent 10 comprises an outer frame 12, an inner frame 14, and a soffit vent grill 16 secured therebetween. Where required, the outer frame 12 and the inner frame 14 may require installation, i.e. securing outer frame (with or without soffit vent grill) to inner frame, securing outer frame (with or without soffit vent grill) to soffit, securing inner frame to soffit, using fastening mechanisms or members, such as screws, nails, bolts, buttons, clasps, tabs, frictional fit mechanisms, loop and hook fastening, such as VELCRO, buttons or snaps, chemical fastening mechanisms, such as chemical binding agents such as glue or an adhesive, or combinations thereof.

The outer frame 12 comprises a plurality of outer frame walls, 18, 20, 22 and 24. Outer frame walls 18 and 20 are orientated in a generally parallel manner relative to each other and are separated by an outer frame space or gap 26. Outer frame walls 22 and 24 are orientated in a generally parallel manner relative to each other and are separated by the space or gap 26. Outer frame walls 22 and 24 may also be orientated in a generally perpendicular manner relative to walls 18 and 20. Each of the outer frame walls, 18, 20, 22 and 24 may contain an angled surface 28, 30, 32, and 34 which extends from a generally planar surface or landing 36. The angled surface may preferably be from 10-25 degrees, or more preferably 19 or 20 degrees. The generally planar surface or landing 36 preferably extends around the inner perimeter 38 of the outer frame 12. The outer frame 12 may be made as a single unit, or may be made of individual units which are secured together using mechanical fastening members such as nails or screws, or chemical fastening members such as glue or an adhesive.

Figure 7:
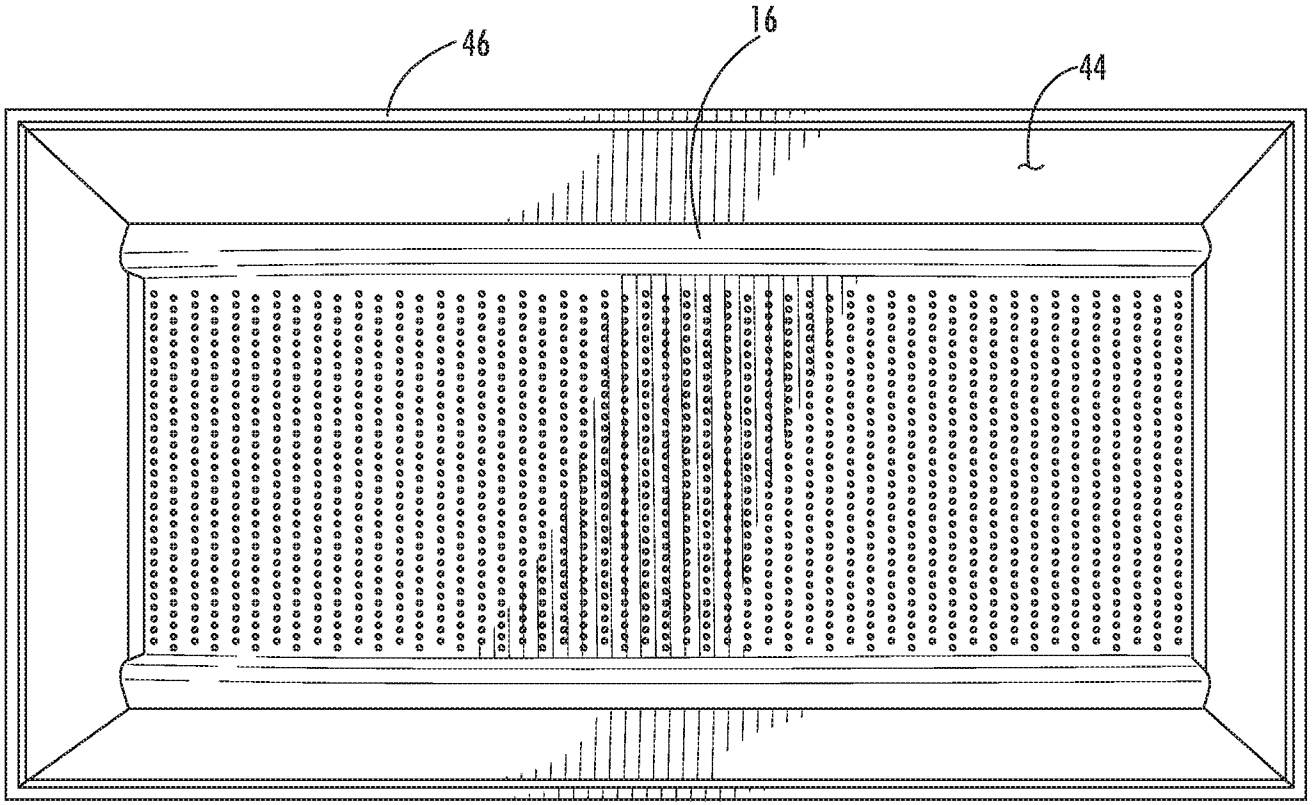
FIG. 7 illustrates the insect and rodent proof soffit vent shown with an inner frame removed.
Figure 8:
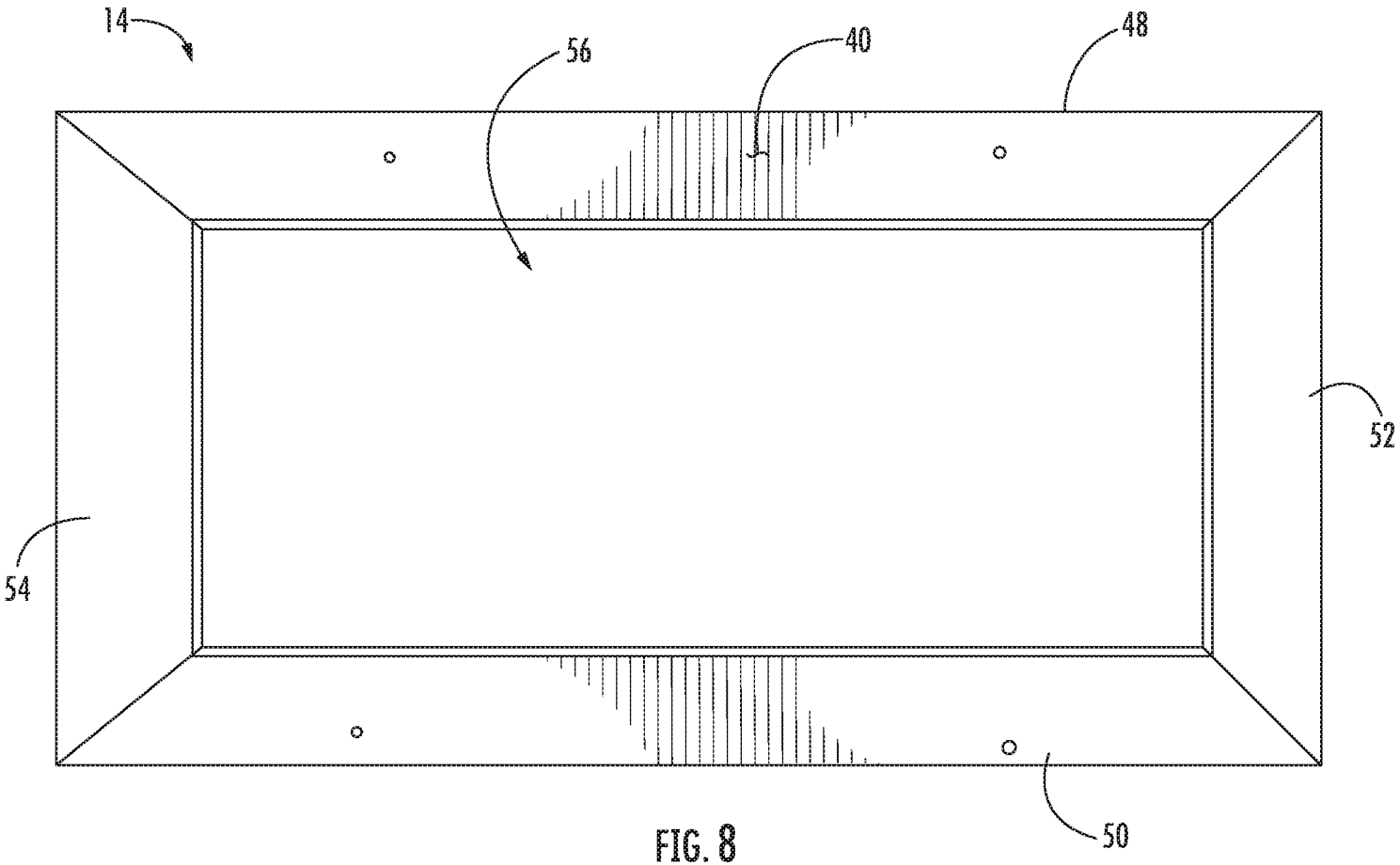
FIG. 8 illustrates a first surface of an embodiment of an inner frame.
Figure 9:
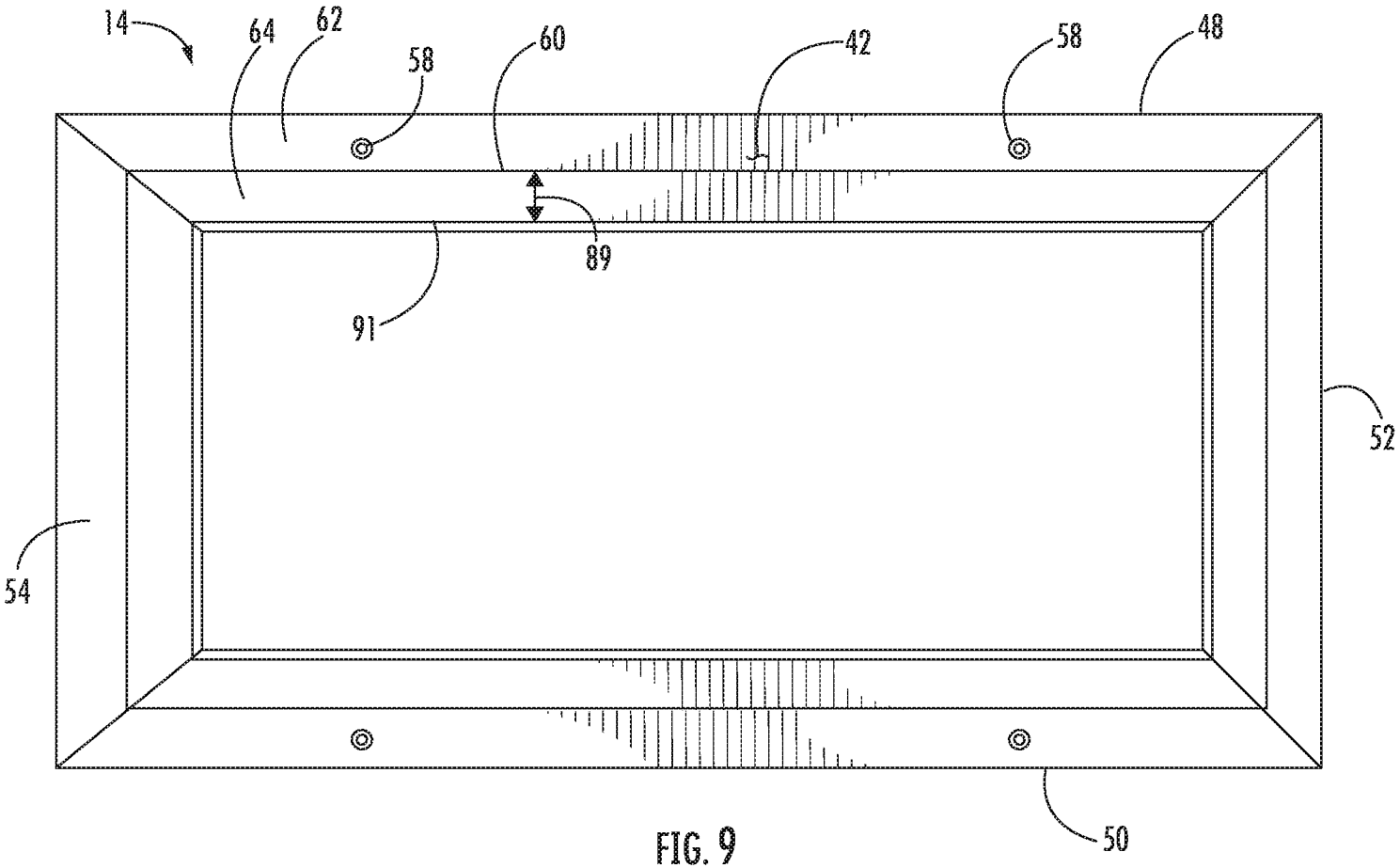
FIG. 9 illustrates a second surface of the inner frame.

Referring to FIGS. 8 and 9, an illustrative example of the inner frame 14 is shown. The inner frame 14 comprises a first surface 40 (FIG. 8) and a second surface 42 (FIG. 9); the second surface 42 being in contact with an inner surface 44 of the outer frame 12, see FIG. 7. The inner frame 14 is preferably sized and shaped to fit within an outer perimeter 46 of the outer frame 12 so that, when inserted therein, it remains flat or flush and does not move significantly in a side to side or up and down manner. The inner frame 14 comprises a plurality of inner frame walls, 48, 50, 52 and 54. The inner frame walls 48 and 50 are orientated in a generally parallel manner relative to each other and are separated by an inner frame space or gap 56. The inner frame walls 52 and 54 are orientated in a generally parallel manner relative to each other and are separated by the space or gap 56. The inner frame walls 52 and 54 may also be orientated in a generally perpendicular manner relative to walls 48 and 50.

The inner frame space or gap 56 is preferably the same size as or smaller than the outer frame space or gap 26. The inner frame 14 may be made as a single unit, or may be made of individual units which are secured together using mechanical fastening members such as nails or screws, or chemical fastening members such as glue or an adhesive. One or more securing member openings 58 may be used to secure the inner frame 14 to either the outer frame 12 or a portion of the soffit or eave areas of the building through securing members, such as screws. The second surface 42 may also contain a raised surface or ridge 60 that spans the entire length of each of the inner frame walls 48, 50, 52 and 54. This raised surface or ridge 60 divides the second surface 42 into an upper portion surface 62 and a lower portion surface 64, forming stepped surfaces. The raised surface or ridge 60 is designed to interact with at least a portion of the soffit vent grill 16 to prevent the soffit vent grill 16 from moving when secured between the outer frame 12 and the inner frame 14.

Figure 10:
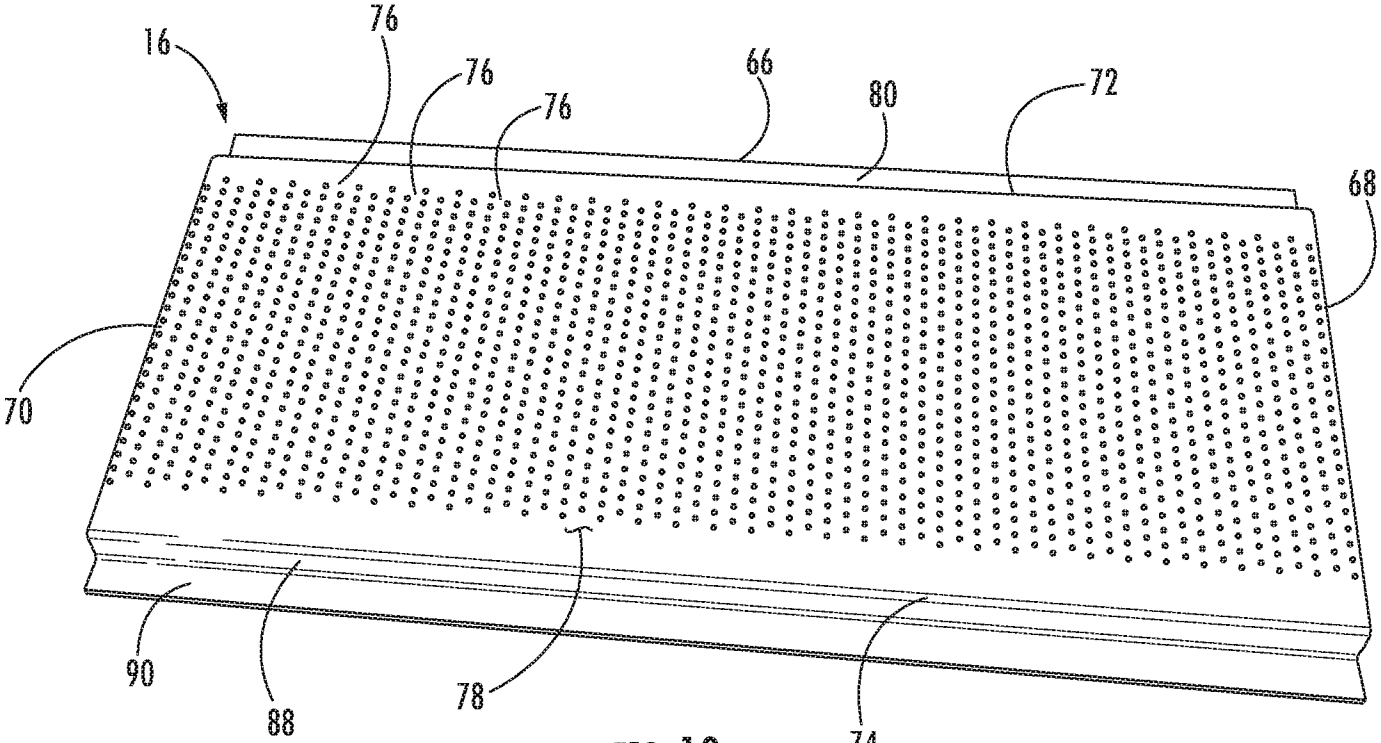
FIG. 10 illustrates an embodiment of a soffit grill.
Figure 11:
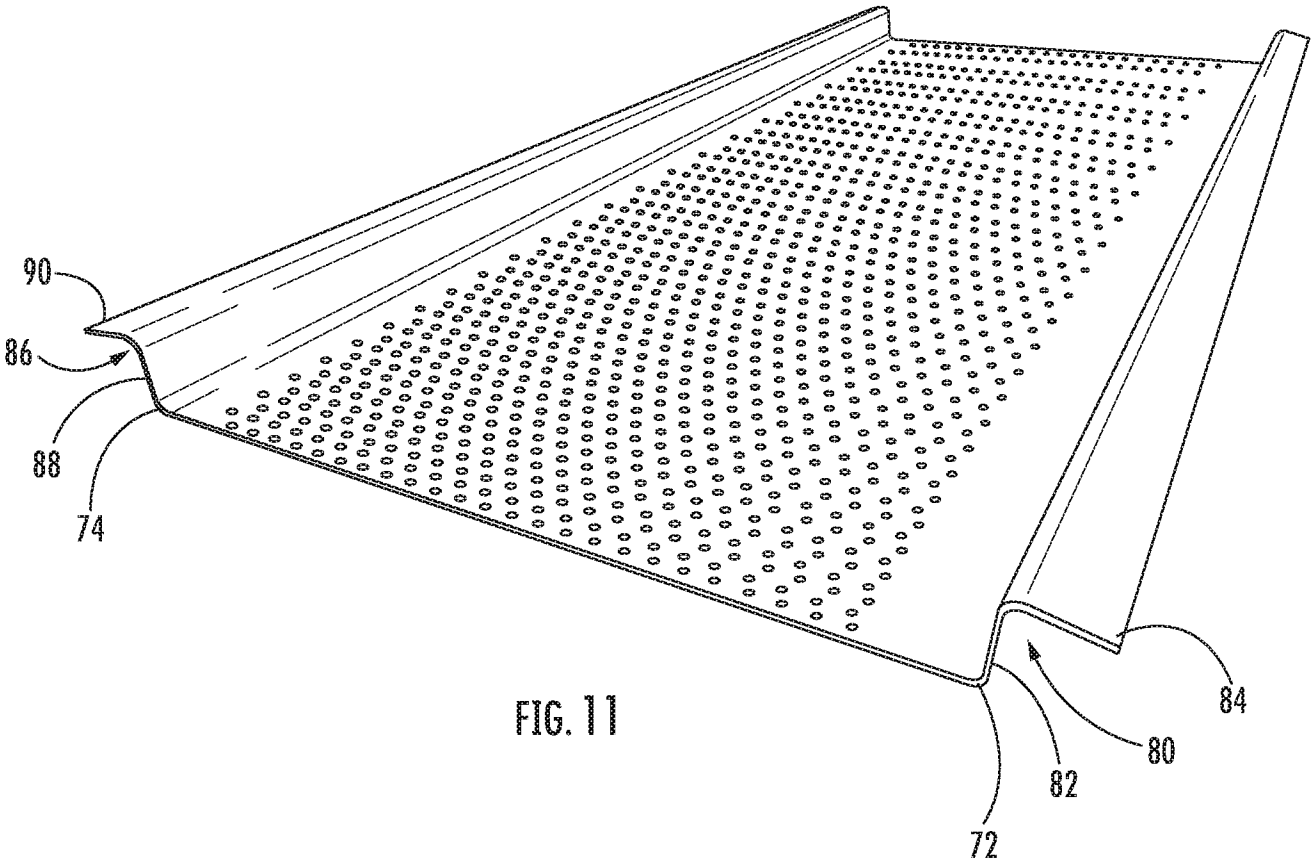
FIG. 11 is an alternative view of the soffit grill.

Referring to FIG. 7, the soffit vent 10 is shown with the inner frame 14 removed, exposing the inner surface 44 of the outer frame 12, with the soffit vent grill 16 secured thereto. FIGS. 10 and 11 illustrate an embodiment of the soffit vent grill 16. The soffit vent grill 16 comprises a main body 66 having a first end 68 and a second opposing end 70. The main body 66 may further comprise a first edge 72 and a second edge 74. A plurality of openings 76 cut or formed within the main body 66 allow air to flow inwardly (from the outside into the building) or outwardly (from the inside of the building towards the outside). While the soffit vent grill 16 is illustrated with a plurality of diagonally arranged openings 76, such illustration is not limiting, as there may be fewer openings 76 than shown, or the openings 76 may be arranged in a different pattern. The size of the openings may be varied depending on the need. Additionally, while the openings 76 are shown as circular in shape, other shapes, such as slots or louvers (horizontal shaped slays that are angled, (fixed or adjustable)) may be used as well. Once secured in place, the inner frame 14 helps prevent the soffit vent grill 16 from vertical, horizontal, or inward movement, thus preventing or minimizing the risk of a soffit vent breach by an animal.

Extending away from the first edge 72 (away from an outer surface 78) is a first outer frame engagement member, illustrated herein as a first flange or winged member 80. The first flange or winged member 80 comprises of two surfaces, a first surface 82 and second surface 84. The first surface 82 extends in a downward direction from the outer surface 78, and is orientated in an angled or perpendicular orientation relative to the main body 66. The second surface 84 extends from the first surface 82 in an outwardly direction, and is orientated or arranged in a generally perpendicular arrangement relative to the first surface 82, thus forming an "L" like shape. The size and shape of the first flange or winged member 80 is configured to interact with at least a portion of the outer frame 12 or the inner frame 14.

Extending away from the second edge 74 (away from an outer surface 78) is a second outer frame engagement member, illustrated herein as a second flange or winged member 86. The second flange or winged member 86 comprises two surfaces, a first surface 88 and a second surface 90. The first surface 88 extends in a downward direction from the outer surface 78, and is orientated at an angle or a perpendicular orientation relative to the main body 66. The second surface 90 extends from the first surface 88 in an outwardly direction and is orientated or arranged in a generally perpendicular arrangement relative to the first surface 88, thus forming an "L" like shape. The size and shape of the second flange or winged member is configured to interact with at least a portion of the outer frame 12 or the inner frame 14. This prevents at least a portion of the soffit grill 16 from moving in a vertical motion when the soffit vent grill 16 is positioned or secured in between the outer frame 12 and the inner frame 14.

The first outer frame engagement member 80 and the second outer frame engagement member 86 are preferably sized to run a length of the main body 66. In addition, the width, i.e. the length from the first surface 82 to the edge of the second surface 84, or the length from the first surface 88 to the edge of the second surface 90, is the same length 89 (FIG. 9) defined by the distance between the inner frame gap inner edge 91 and the raised surface or ridge 60.

Figure 12A:
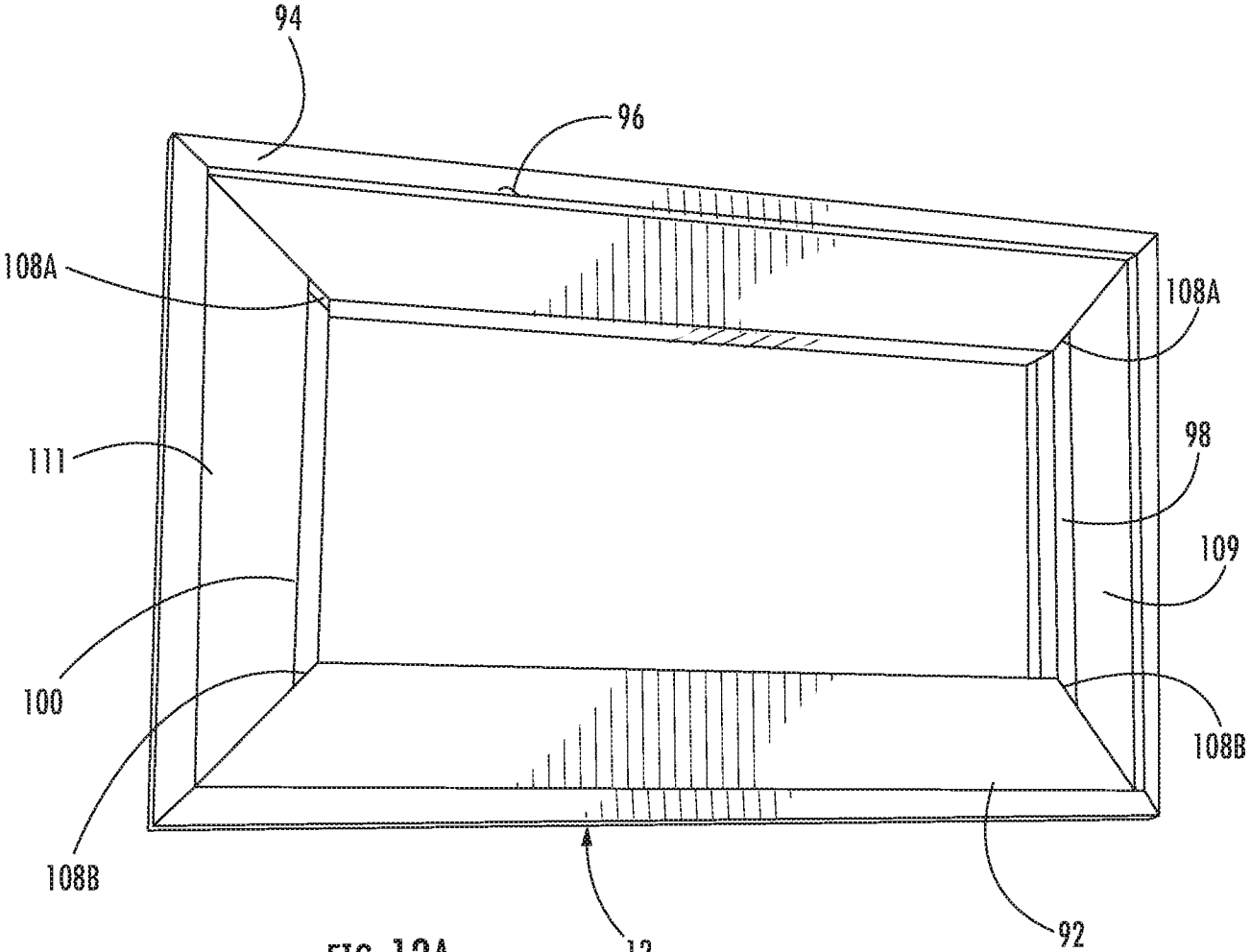
FIG. 12A illustrates an inner surface of the outer frame.
Figure 12B:
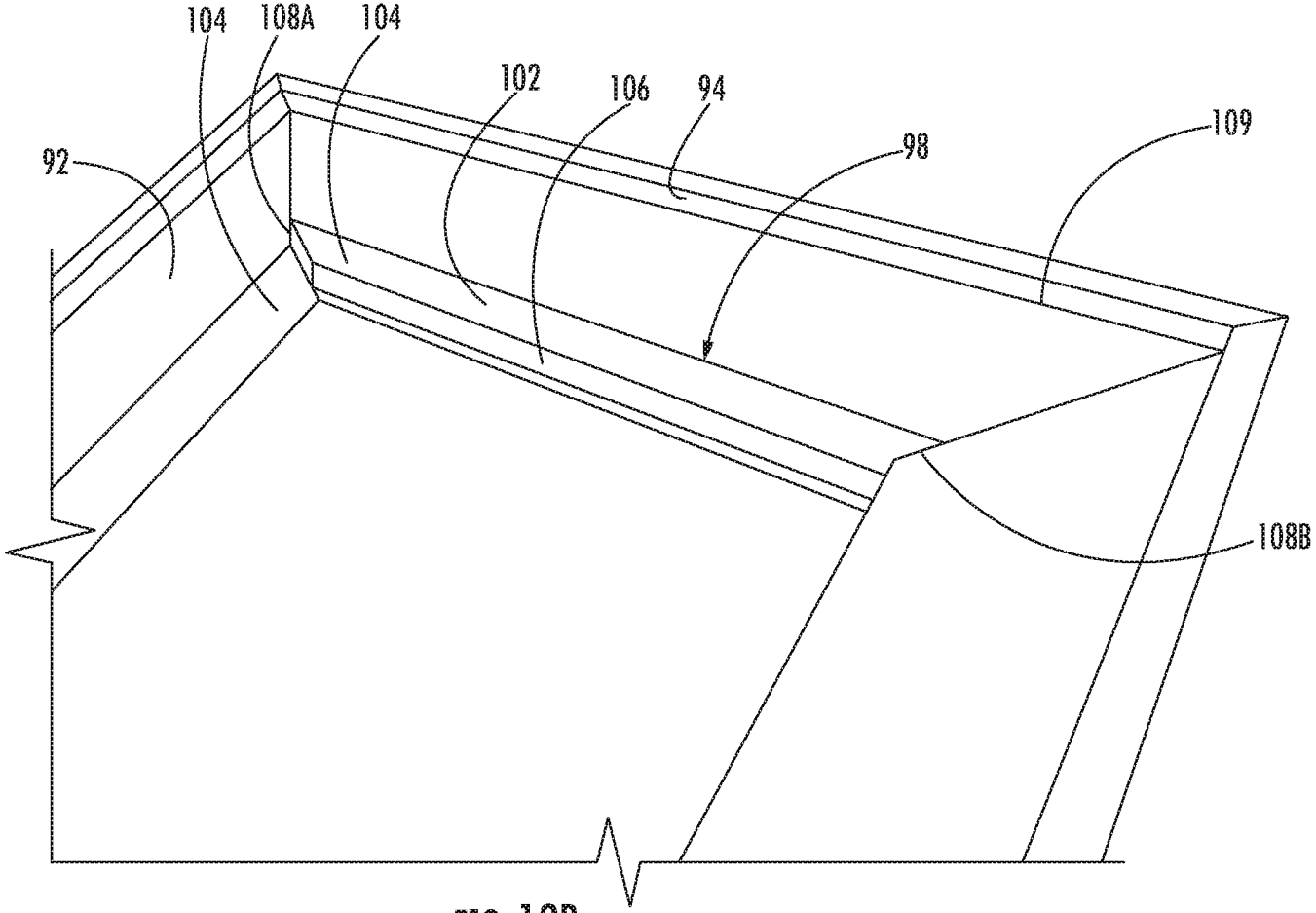
FIG. 12B is a close-up view of a portion of the outer frame.
Figure 13:
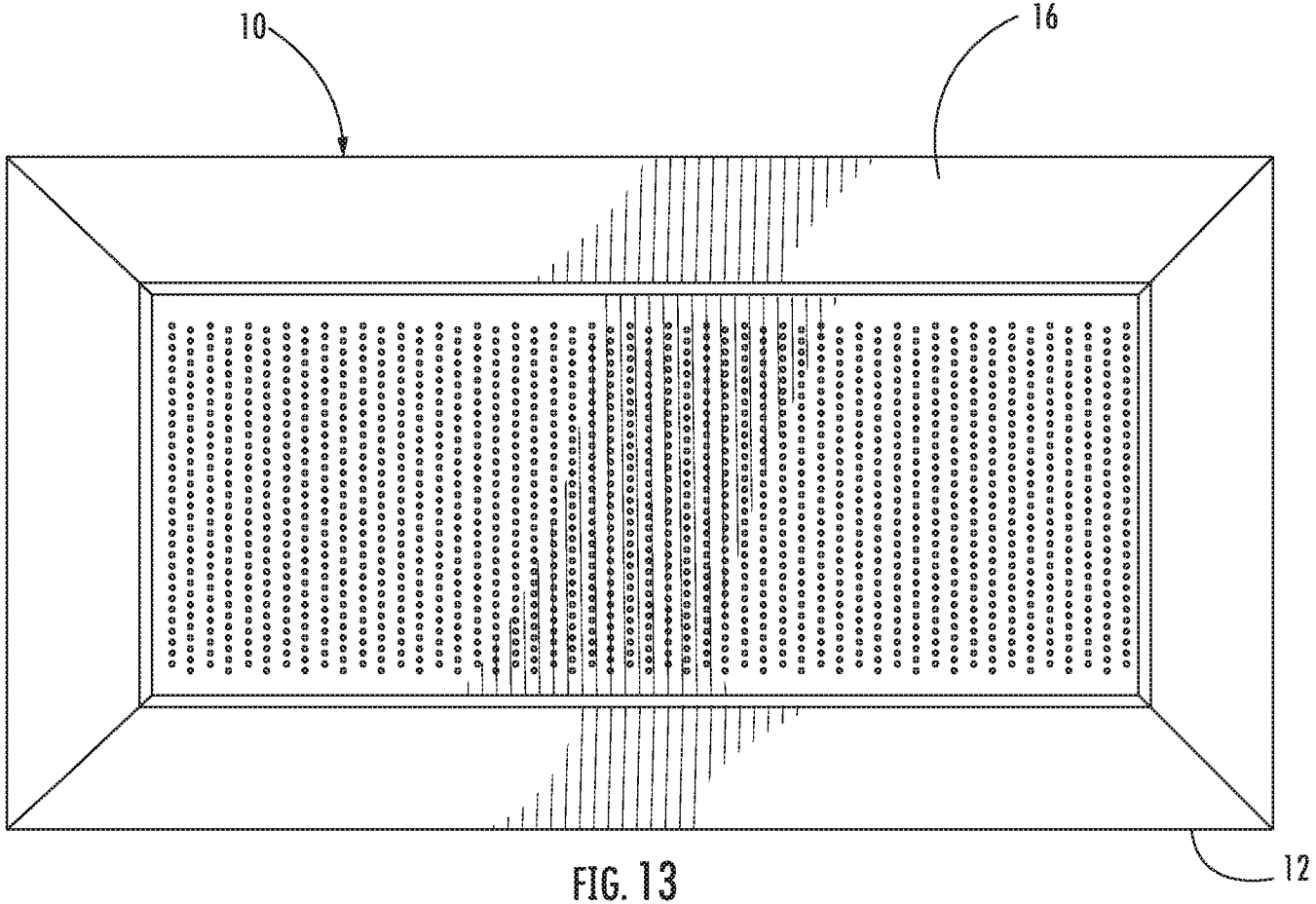
FIG. 13 illustrates an embodiment of the insect and rodent proof soffit vent having an alternative embodiment of an inner frame.
Figure 14:
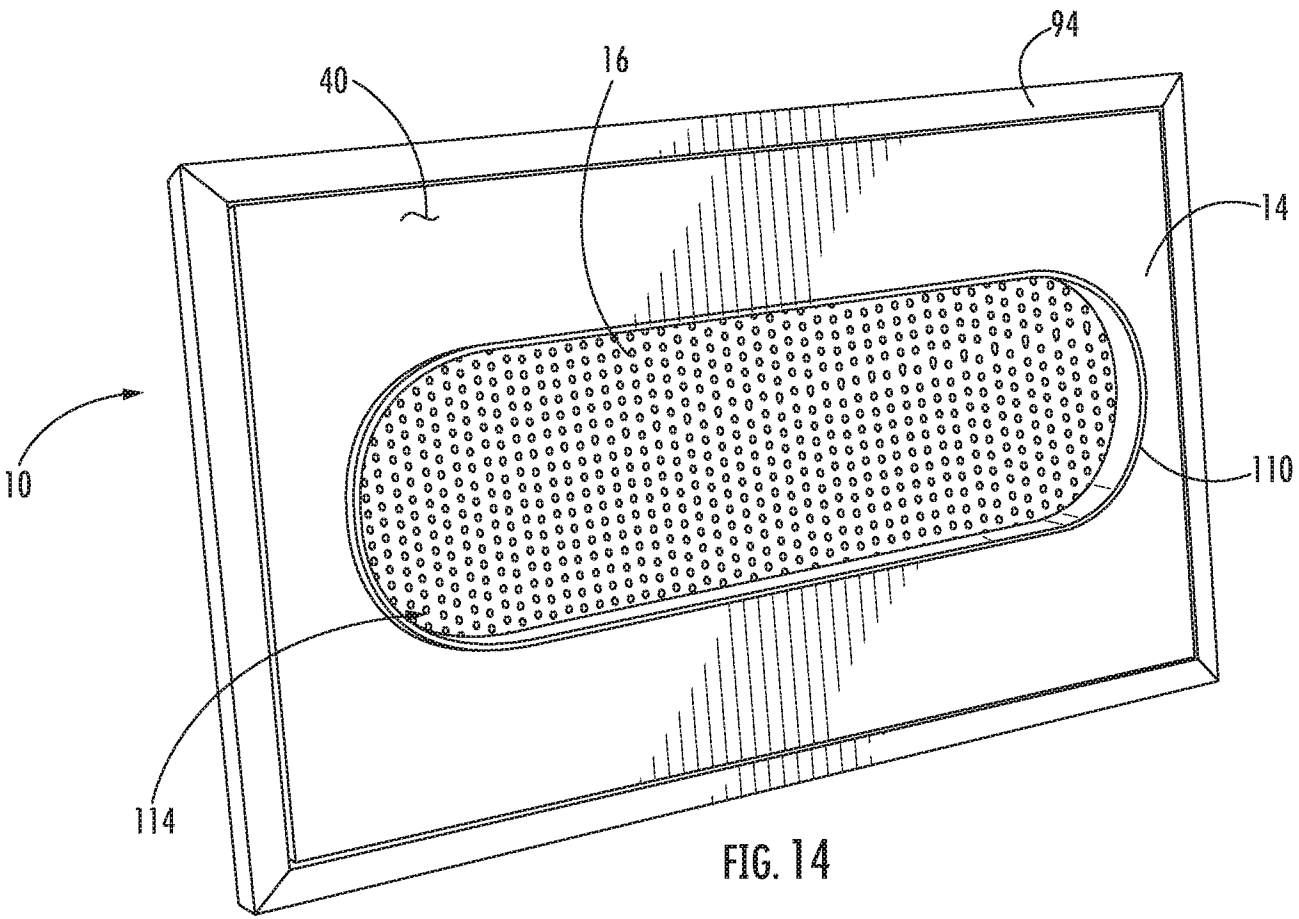
FIG. 14 illustrates an interior view of the insect and rodent proof soffit vent shown in FIG. 13.
Figure 15:
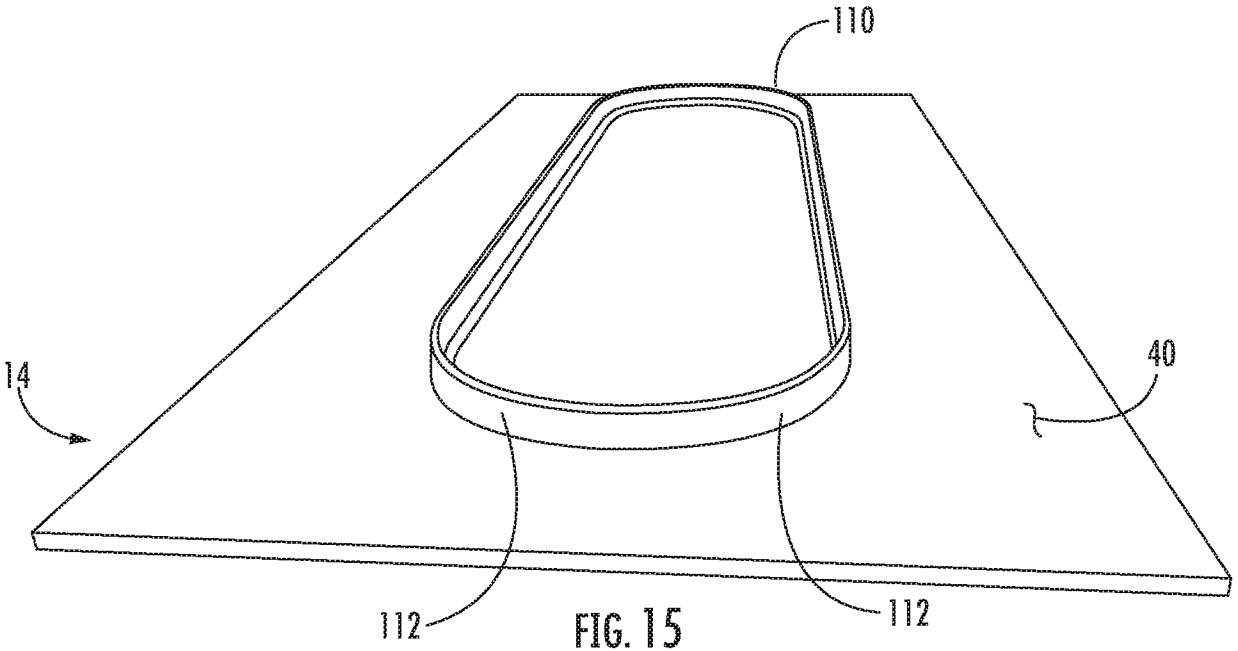
FIG. 15 illustrates the inner frame of the view of the insect and rodent proof soffit vent shown in FIG. 13.
Figure 16:
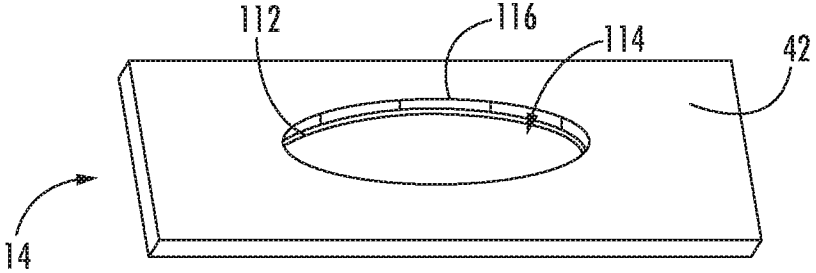
FIG. 16 illustrates the first surface of the inner frame of the insect and rodent proof soffit vent shown in FIG. 13.

FIGS. 12A and 12B illustrate the interior surface 92 (surface that faces the soffit or eave when installed) of the outer frame 12, with the inner frame 14 and the soffit grill 16 removed. A lip or border 94, which extends away from the interior surface 92, extends around the perimeter of the outer frame 12. Preferably, the size of the lip or border 94 (from the interior surface 92 to the top surface 96 of the lip or border 94) is preferably the same size as the width of the inner frame 14, so that when the inner frame 14 is inserted or placed on top of the outer frame 12, the inner frame 14 is flush with the outer frame 12. To properly secure the soffit grill 16 to the outer frame 12, the first end 68 of the main body 66 engages with, such as through a frictional fit, a first soffit grill receiving member 98, and the second end 70 of the main body 66 engages with, such as through a frictional fit, a second soffit grill receiving member 100. The frictional fit prevents vertical, horizontal, or inward movement associated with the soffit grill 16, thus preventing or minimizing the risk of a soffit vent breach by an animal without applying a predetermined force that may overcome the frictional fit. While the use of frictional fit is described, other means of engagement or securing, such as the use of staples, screws, nails, or chemical fastening, such as glue, may be used as well.

FIG. 12B is a close-up view of the first soffit grill receiving member 98. The first soffit grill receiving member 98 is shown comprising a cut out portion 102 within an outer frame inner side wall 104, thus forming an outer frame inner side wall ledge 106. Edge cut outs 108A and 108B are located on both sides of the first end 109 of the outer frame 12. When inserted, at least a portion of the soffit grill 16 rests on top of the outer frame inner side wall ledge 106 and butts up against the cut-out portion 102 of the outer frame inner side wall 104. In addition, the first flange or winged member 80 and the second flange or winged member 86 help maintain the soffit grill 16 in place. The second soffit grill receiving member 100 has the same features as described for the first soffit grill receiving member 98.

Once inserted, the first flange or winged member first surface 82 and second surface 84 are aligned with and rest against at least a portion of the outer frame inner side wall 104, and simultaneously, at least a portion of the interior surface 92. The second flange or winged member first surface 88 and second surface 90 are aligned with and rest against at least a portion of the outer frame inner side wall 104, and simultaneously, at least a portion of the interior surface 92. When the inner frame 14 is secured in or to the outer frame 12, thereby resting on top of the soffit grill 16, such alignment prevents movement of the soffit grill 16 when a force is applied from the outside (i.e. a force, such as from a rodent, pushing the soffit grill 16 in towards the interior of a building when the soffit vent 10 is installed therein.

Figure 17A:
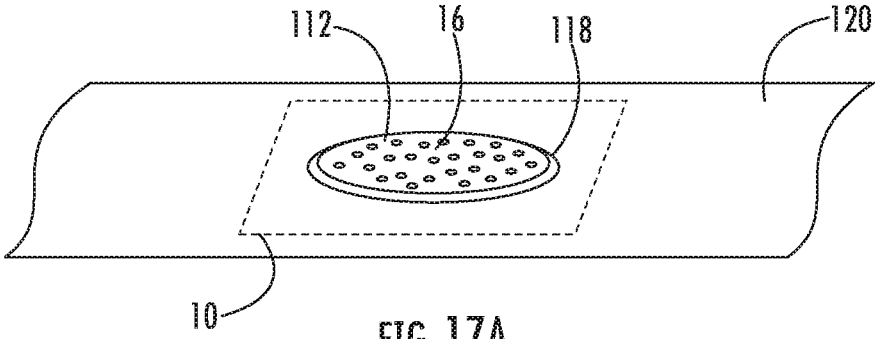
FIG. 17A is a partial view of the soffit or eave with the insect and rodent proof soffit vent shown in FIG. 13 inserted therein.

Referring to FIGS. 13-16, a soffit vent 10 is shown with the outer frame 12, the soffit grill 16, and an alternative embodiment of the inner frame 14. The inner frame 14 contains all of the same features as described previously, but also includes a self-centering installation member 110. The guide member 110 comprises a plate or continuous wall 112 that extends away from the inner frame 14 first surface 40 and contours or mirrors the shape of the inner frame space or gap 56, which is shown as a generally oval shaped opening 114. The self-centering installation member 110 is shown extending around the perimeter 116 of the oval shaped opening 114. While the inner frame space or gap 56 is shown as a generally oval shaped opening, other shapes may be used as well. Whatever shape the inner frame space or gap 56 assumes, the self-centering installation member 110 is configured to be inserted into a preexisting soffit or eave opening 118 of a soffit or eave 120, see FIG. 17A, thus providing a mechanism to insert the soffit vent 10 into the soffit or eave opening 118. In this manner, the continuous wall 112 abuts the soffit or eave opening 118 and maintains the inner frame 14 in place. In use, the self-centering installation member 110 may first be screwed or clipped into a soffit 120. The outer frame 12 can then be installed with no visible screw holes present. The shape of the plate or continuous wall 112 should be the same as the shape of the soffit opening. In this case, the oval shape of the self-centering installation member 110 would fit perfectly into the soffit opening 118 to create a self-aligning installation plate.

Figure 17B:
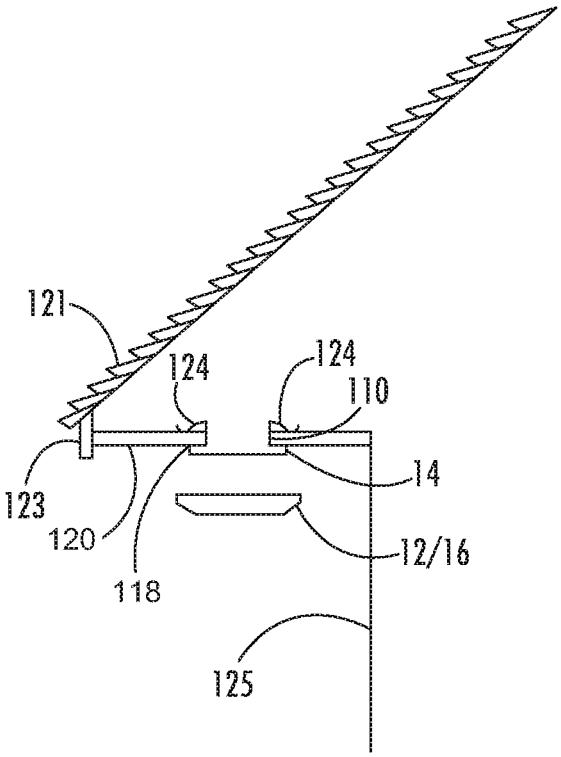
FIG. 17B illustrates the insect and rodent proof soffit vent shown in FIG. 13, configured for tool free installation, and shown installed within a soffit opening.
Figure 17C:
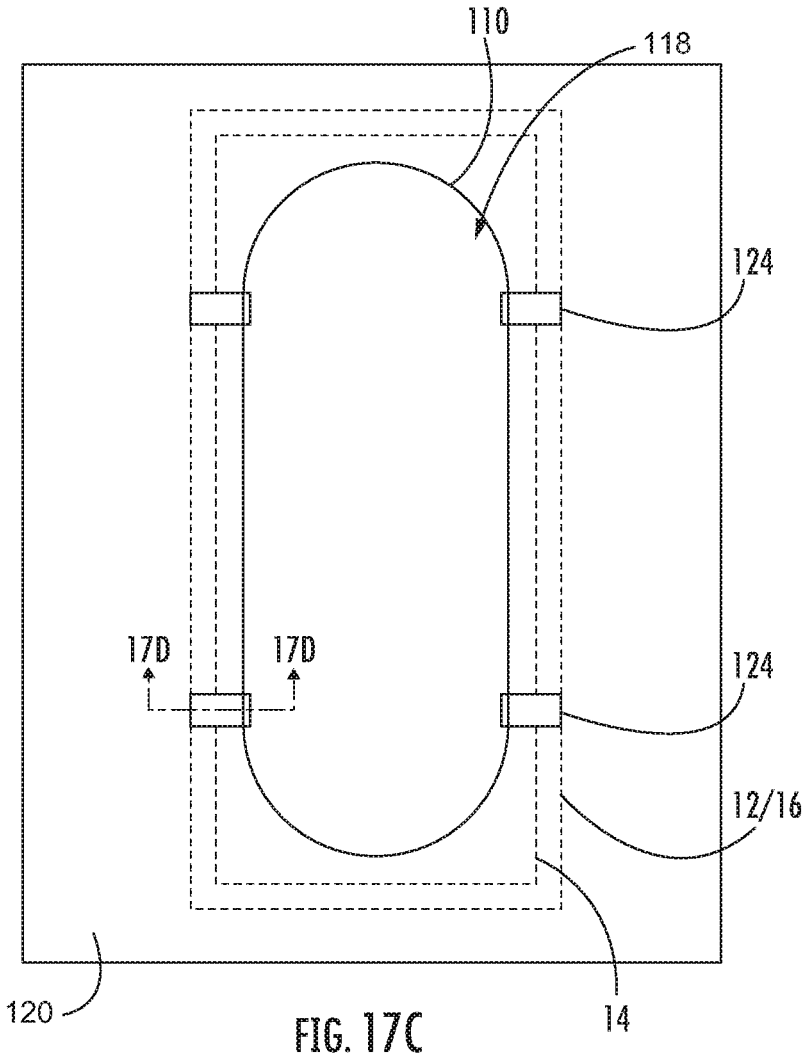
FIG. 17C represents a top view of the insect and rodent proof soffit vent shown in FIG. 17B, with the roof removed.
Figure 17D:
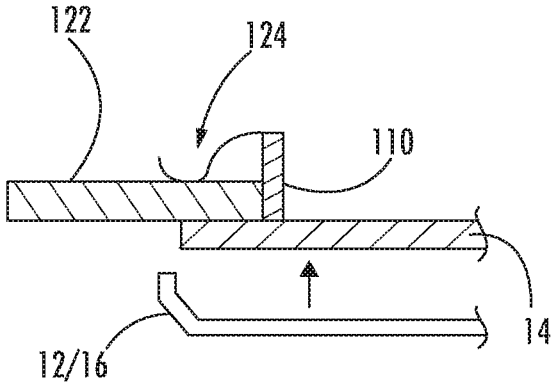
FIG. 17D is a cross-sectional view taken along lines 17D-17D in FIG. 17C.

FIGS. 17B-17D illustrate an embodiment of the soffit vent 10 configured for tool free installation. As illustrated in the figures, the self-centering installation member 110 of the inner frame 14 is shown installed into the soffit opening 118 within soffit 120. FIG. 17C is a top view with the roof 121 fascia 123, and exterior wall 125 removed. One or more soffit securing members, illustrated herein as slide clips 124 (with a J-like shaped arm), secure the inner frame 14 to the soffit 120 without the need of installation tools or equipment, such as screws, drills, or hammers. The slide clips 124 may have a hinge, have or act as a spring, or otherwise be configured to exert a force when an equal or greater force is applied, so that the clip 124 can be extended a distance in which the clip extends over or above the width of the soffit 120 when a forced is applied, but spring or move back to or towards its original position when the tension is removed and maintain a pressure or force thereupon the soffit 120. This allows the soffit 120 to rest in between the clip 124 and the inner frame 14, secured in place. Alternatively, the clip 124 can be designed to rotate or slide side to side during insertion or removal. In use, the inner frame 14 would be installed first to the soffit 120. The clips would then be moved to the secured position, i.e. slid sideways, thereby firmly holding the inner frame 14 and the self-centering installation member 110 in place. The outer frame 12, with the soffit grill 16, could then be secured in place to the inner frame 14 via securing members, preferably a clip as well.

Figure 18:
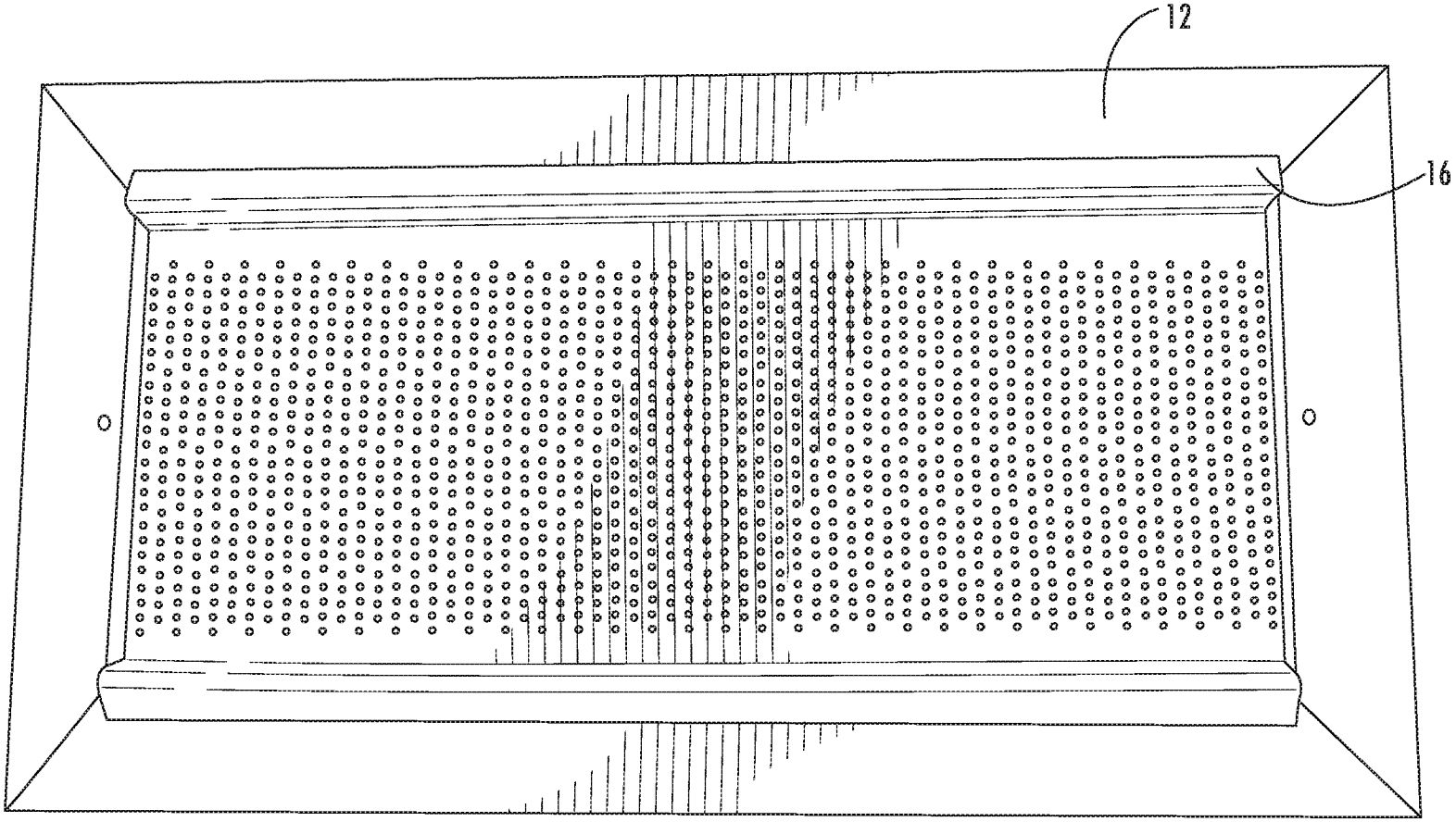
FIG. 18 is an embodiment of the insect and rodent proof soffit vent that does not utilize an inner frame.

FIG. 18 illustrates an embodiment of the soffit vent 10 which does not utilize an inner frame 14. The outer frame 12, as shown, includes all the same features as described above, but does not include the lip or border 94. The outer frame 12 illustrated in the figure also interacts with the soffit grill 16 as described above.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A soffit vent for allowing passage of air into an interior area of a building structure through an opening of a soffit having said soffit vent, and which prevents or minimizes animals from entering into said interior area through said soffit vent comprising:

an outer frame having a space or gap configured to allow passage of fluid, said outer frame having an inner surface configured to receive and hold at least a portion of an inner frame;

said inner frame having a surface which is in contact with said inner surface of said outer frame and having a space or gap configured to allow passage of fluid; and a soffit vent grill, said soffit vent grill is positioned within said outer frame and in between said outer frame and said inner frame in a manner which prevents vertical, horizontal, and inward movement and is constructed to allow fluid flow;

wherein said inner frame is configured to extend through the openings of the soffit and engage a top surface and an opposite bottom surface of the soffit; and wherein said outer frame and soffit vent gill is configured to be located below the soffit.

2. The soffit vent according to claim wherein said outer frame includes at least one wall having an outer, angled surface.

3. The soffit vent according to claim 2 wherein said angled surface between 10° and 25°.

4. The soffit vent according to claim 1 wherein said soffit vent grill is secured to said outer frame in a manner which prevents vertical or horizontal movement without applying a predetermined force.

5. The soffit vent according to claim 4 wherein said outer frame further comprises at least one soffit grill receiving member configured to engage with or secure at least a portion of said soffit vent grill in position.

6. The soffit vent according to claim 5 wherein said at least one soffit grill receiving member comprises a stepped surface.

7. The soffit vent according to claim 4 wherein said outer frame engages with or secures at least a portion of said soffit vent grill in position through frictional fit.

8. The soffit vent according to claim 1 wherein said outer frame includes a lip or border around an outer frame perimeter.

9. The soffit vent according to claim 8 wherein said inner frame is sized and shaped to fit within said lip or border.

10. The soffit vent according to claim 1 wherein said inner frame includes a raised surface or ridge that spans the entire length of said inner frame.

11. The soffit vent according to claim 1 wherein said soffit vent grill further comprises:

a main body;

a first outer frame engagement member constructed and arranged to contact at least a portion of said outer frame; and a second outer frame engagement member constructed and arranged to contact at least a portion of said outer frame.

12. The soffit vent according to claim 11 wherein said first outer frame engagement member and said second outer frame engagement member are sized to run a length of said main body.

13. The soffit vent according to claim 1 wherein said soffit vent grill contains at least one opening for allowing fluid flow.

14. The soffit vent according to claim 1 wherein said inner frame comprises a self-centering installation member.

15. The soffit vent according to claim 14 wherein said self-centering installation member includes a wall which extends away from an inner frame surface.

16. The soffit vent according to claim 15 wherein said self-centering installation wall extends around a perimeter of said space or gap of said inner frame.

* * * * *